US007713673B2

(12) United States Patent
Katano et al.

(10) Patent No.: US 7,713,673 B2
(45) Date of Patent: May 11, 2010

(54) FIXING LIQUID, TONER FIXING METHOD, TONER FIXING DEVICE, IMAGE FORMING METHOD, AND IMAGE FORMING APPARATUS

(75) Inventors: Yasuo Katano, Kanagawa (JP); Tsuneo Kurotori, Tokyo (JP); Tomoyasu Hirasawa, Tokyo (JP); Hiromichi Komai, Kanagawa (JP); Takuma Nakamura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 690 days.

(21) Appl. No.: 11/643,613

(22) Filed: Dec. 20, 2006

(65) Prior Publication Data

US 2007/0147913 A1 Jun. 28, 2007

(30) Foreign Application Priority Data

Dec. 28, 2005 (JP) ..... 2005-380472

(51) Int. Cl.
*G03G 13/20* (2006.01)

(52) U.S. Cl. ..... 430/124.21; 399/325; 399/320

(58) Field of Classification Search ..... 430/124.21; 399/320, 325

See application file for complete search history.

(56) References Cited

U.S. PATENT DOCUMENTS

| | | | | |
|---|---|---|---|---|
| 3,907,695 | A * | 9/1975 | Amidon et al. | 430/115 |
| 5,476,739 | A | 12/1995 | Takama et al. | |
| 5,666,628 | A | 9/1997 | Fukai | |
| 2004/0131402 | A1 | 7/2004 | Kurotori et al. | |
| 2005/0254867 | A1 | 11/2005 | Kurotori et al. | |
| 2006/0115762 | A1 | 6/2006 | Katano et al. | |
| 2006/0263712 | A1 | 11/2006 | Katano et al. | |

FOREIGN PATENT DOCUMENTS

| | | | |
|---|---|---|---|
| EP | 0636946 | A1 | 2/1995 |
| EP | 1653294 | A2 | 5/2006 |
| EP | 1724644 | A1 | 11/2006 |
| JP | 53-118139 | | 10/1978 |
| JP | 59-119364 | | 7/1984 |
| JP | 3290513 | | 3/2002 |
| JP | 2004-109749 | | 4/2004 |

* cited by examiner

*Primary Examiner*—Mark A Chapman
(74) *Attorney, Agent, or Firm*—Cooper & Dunham LLP

(57) ABSTRACT

A fixing liquid is provided which fixes a toner comprising a resin on a recording medium, in which a fluid particle comprising a component which dissolves or swells at least a portion of the resin comprised in the toner is dispersed in a dispersive medium, as a micro-emulsion.

19 Claims, 6 Drawing Sheets

FIXING LIQUID, TONER FIXING METHOD, TONER FIXING DEVICE, IMAGE FORMING METHOD, AND IMAGE FORMING APPARATUS

BACKGROUND

1. Technical Field

This disclosure relates to a fixing liquid, a toner fixing method, a toner fixing device, an image forming method, and an image forming apparatus.

2. Description of the Related Art

An image forming apparatus such as a printer, a facsimile machine and a copying machine is an apparatus for forming an image containing a character or a symbol on a recording medium such as a paper medium, a cloth medium, and an OHP sheet, based on image information. In particular, an electrophotographic image forming apparatus has been widely used in an office since a high-resolution image can be formed on a normal paper sheet at a high speed. In such an electrophotographic image forming apparatus, a heat-fixing method has been widely used in which toner on a recording medium is heated and melted and the melted toner is pressurized so as to fix the toner on the recording medium. The heat-fixing method has been preferably used since a high fixation speed and a high fixed image quality, etc., can be provided.

However, an approximately half or more of an electric power consumed in such an electrophotographic image forming apparatus is consumed for heating toner in the heat-fixing method. On the other hand, a fixing device with a low electric power consumption (energy saving-type one) has been desired from the viewpoint of measures of environmental problems in recent years. That is, to extremely lower a temperature at which toner is heated to fix the toner, relative to conventional one, or a fixing method in which no heating of toner is required has been desired. Particularly, a non-heating fixing method of fixing a toner on a recording medium without heating the toner is ideal in terms of low electric power consumption.

As such a non-heating fixing method, for example, Japanese Patent No. 3290513 discloses a wet-type process for fixing toner wherein toner is dissolved or swelled by spraying or dipping an oil-in-water-type fixing agent capable of dissolving or swelling the toner onto the surface of a fixation medium on which unfixed toner is arranged at a predetermined position, in which agent an organic compound being insoluble or difficult to dissolve in water is dispersed and mixed in water, and subsequently, the fixation medium is dried.

However, when a large quantity of the fixing agent is applied onto an unfixed toner in the wet-type fixation process disclosed in Japanese Patent No. 3290513, a recording medium (a fixation medium) such as a transcription paper sheet absorbs a water content of the fixing agent so that cockle or curl is generated in the recording medium, since the oil-in-water-type fixing agent is used in which an organic compound being insoluble or difficult to dissolve in water is dispersed and mixed in water. Accordingly, stable and high-speed conveyance of the recording medium which is required for an image forming apparatus is significantly hindered. Then, when a large quantity of water contained in the fixing agent is evaporated by using a drying device so as to remove the water content from the fixing agent applied on the recording medium, an electric power is required which is comparable to an electric power consumed in an image forming apparatus for which a heat-fixing method is used.

Also, the surfaces of tone particles are commonly subjected to water-repellency treatment using a hydrophobic silica in order to prevent the toner particles from absorbing moisture in the atmosphere to aggregate to one another and maintain the fluidity of the toner. Therefore, when an aqueous fixing liquid containing water as a dispersive medium, such as a fixing agent as described above, is sprayed or dipped onto an unfixed toner on a recording medium, toner fluid particles subjected to a water repellency treatment are repelled by the aqueous fixing liquid. As a result, a blank portion is formed in a toner image and a defect is generated in the image.

FIGS. 1A, 1B and 1C are diagrams illustrating a fixing method of applying a water-based fixing liquid onto a toner subjected to water repellency treatment on a recording medium. As shown in FIG. 1A, a liquid drop of water-based fixing liquid 13 is dropped onto a layer of unfixed toner 12 subjected to water repellency treatment which has been transcribed on a recording paper sheet 11 as a recording medium by an appropriate fixing liquid applying device. Then, as shown in FIG. 1B, when the liquid drop of water-based fixing liquid 13 contacts the layer of unfixed toner 12 subjected to water repellency treatment, a particle of unfixed toner 12 subjected to water repellency treatment is repelled by the liquid drop of water-based fixing liquid 13. As a result, as shown in FIG. 1C, the particle of unfixed toner 12 subjected to water repellency treatment which has been repelled by the liquid drop of water-based fixing liquid 13 moves to the periphery of the water-based liquid drop 13, with the spreading of the water-based fixing liquid 13 on the recording paper sheet 11. Then, an undesirable blank portion in the toner subjected to water repellency treatment is formed on the layer of unfixed toner 12 subjected to water repellency treatment which has been transcribed on the recording paper sheet 11, whereby a defect is generated in a toner image. Thus, when the water-based fixing liquid 13 is used, there is a problem such that the layer of unfixed toner 12 which has been transcribed on the recording paper sheet 11 is readily disturbed.

Then, as a fixing liquid which repels no unfixed toner subjected to water repellency treatment, there is disclosed a non-aqueous fixing liquid in which a material for dissolving or swelling a toner is dissolved in a non-aqueous solvent. For example, Japanese Laid-Open Patent Application No. 2004-109749 discloses a fixing liquid in which an aliphatic dibasic acid ester, etc., as a component of a material for dissolving or swelling a resin component constituting a toner is diluted (or dissolved) with a non-volatile dimethylsilicone as a diluent (solvent). Also, for a solution for fixation which can be used for a fixing method capable of sharply and readily fixing an unfixed image formed by an electrostatic method on a image receiving sheet without disturbing the image, Japanese Laid-Open Patent Application No. 59-119364 discloses a mixed solution for fixing an image of unfixed toner which can dissolve the toner and be provided by admixing 8-120 parts by volume of a silicone oil into 100 parts by volume of a solvent having a miscibility to the silicone oil. Such a non-aqueous fixing liquid contains a non-aqueous solvent having a high affinity with an unfixed toner subjected to water repellency treatment and, therefore, can dissolve or swell a toner without repelling the unfixed toner subjected to water repellency treatment, so that the toner can be fixed on a recording medium.

Herein, the use of a VOC (volatile organic compound) as a non-aqueous solvent used for a non-aqueous fixing liquid is not preferable since it brings an adverse affect to a human body and generates unpleasant odor. Therefore, as a non-aqueous solvent used for a non-aqueous fixing liquid, in fact, a non-volatile non-aqueous solvent is used.

However, a non-aqueous fixing liquid in which a material for dissolving or swelling a toner is dissolved in a non-volatile non-aqueous solvent has a high permeability into a recording medium. Therefore, when a non-aqueous fixing liquid as described above is sprayed or dropped onto an unfixed toner on a recording medium, the non-aqueous fixing liquid diffuses on and penetrates through the recording medium with a high speed, and only a portion of the material for dissolving or swelling a toner which is contained in the non-aqueous fixing liquid dissolves or swells the unfixed toner on the recording medium. Then, the remaining portion of the material for dissolving or swelling a toner is not utilized for dissolving or swelling the toner but diffuses on or penetrates through the recording medium with the non-aqueous solvent. Thus, since only a portion of the material for dissolving or swelling a toner which is contained in the non-aqueous fixing liquid dissolves or swells an unfixed toner on a recording medium, it is necessary to increase the concentration of the material for dissolving or swelling a toner which is contained in the non-aqueous solvent. For example, the inventors have found that the concentration of a solvent dissolved in a silicone oil as a non-aqueous solvent is necessarily equal to or more than 20% by weight with respect to a solution for fixation disclosed in Japanese Laid-Open Patent Application No. 59-119364. Therefore, in regard to a non-aqueous fixing liquid in which a material for dissolving or swelling a toner is dissolved in a non-volatile non-aqueous solvent, the toner dissolving or swelling efficiency of the material for dissolving or swelling a toner is low.

FIGS. 2A, 2B, and 2C are diagrams illustrating a fixing method of applying a non-aqueous fixing liquid onto a toner subjected to water repellency treatment on a recording medium in which liquid a material for dissolving or swelling a toner is dissolved in a non-volatile non-aqueous solvent. As shown in FIG. 2A, a liquid drop of a non-aqueous fixing liquid 23 in which a material for dissolving or swelling a toner is dissolved in a non-volatile non-aqueous solvent is dropped onto a layer of unfixed toner 22 subjected to water repellency treatment which has been transcribed on a recording paper sheet 21 as a recording medium by an appropriate fixing liquid applying device. Then, as shown in FIG. 2B, the non-aqueous fixing liquid 23 described above which has contacted the recording paper sheet 21 has a high permeability into the recording paper sheet 21 and rapidly permeates into the recording paper sheet 21. As a result, as shown in FIG. 2C, a portion of the material for dissolving or swelling a toner which is contained in the non-aqueous fixing liquid 23 can dissolve or swell the unfixed toner 22 on the recording paper sheet 21, and, however, the remaining portion of the material for dissolving or swelling a toner does not dissolve or swell the unfixed toner 22 on the recording paper sheet 21 but penetrates through or diffuses on the recording paper sheet 21 with the non-volatile non-aqueous solvent. Thus, when a non-aqueous fixing liquid is used in which a material for dissolving or swelling a toner is dissolved in a non-volatile non-aqueous solvent, there is a problem such that the efficiency of utilizing the material for dissolving or swelling a toner is low.

Therefore, a fixing liquid may be desirable which is capable of fixing a toner on a recording medium more efficiently.

More specifically, it may be desirable to provide a fixing liquid, a toner fixing method, a toner fixing device, an image forming method, and an image forming apparatus, which are capable of fixing a toner on a recording medium more efficiently.

BRIEF SUMMARY

According to an aspect of this disclosure, there is provided a fixing liquid which fixes a toner comprising a resin on a recording medium, in which a fluid particle comprising a component which dissolves or swells at least a portion of the resin comprised in the toner is dispersed in a dispersive medium, as a micro-emulsion.

According to another aspect of this disclosure, there is provided a toner fixing device in which a toner comprising a resin is fixed on a recording medium by using the fixing liquid as described above.

According to another aspect of this disclosure, there is provided an image forming apparatus in which an image of a toner comprising a resin is formed on a recording medium by using the fixing liquid as described above.

DETAILED DESCRIPTION OF THE PREFERRED EMBODIMENTS

Figure 1A:
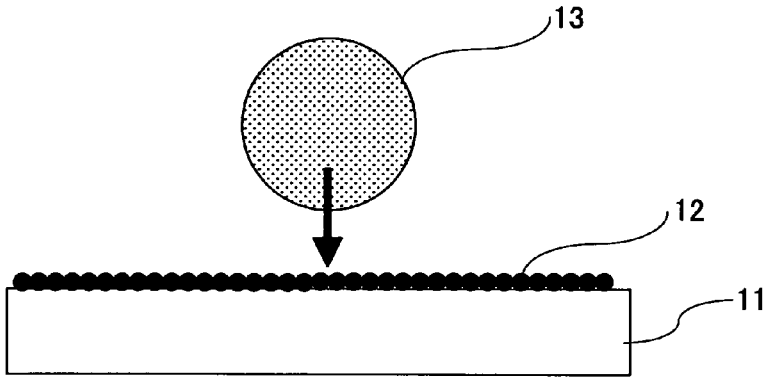
FIGS. 1A, 1B, and 1C are diagrams illustrating a fixing method of applying an aqueous fixing liquid onto a toner subjected to water repellency treatment on a recording medium.
Figure 1B:
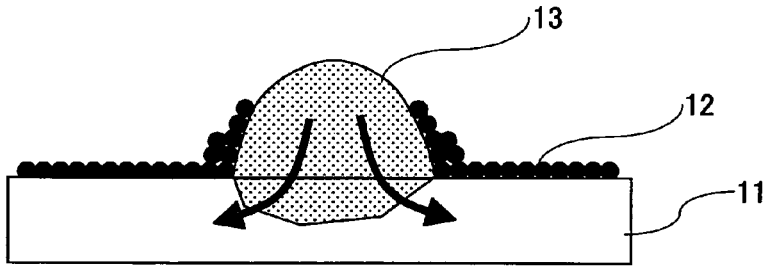
Figure 1C:
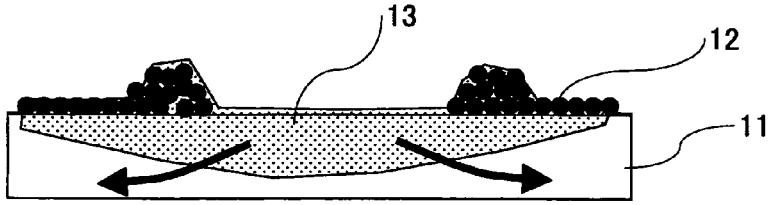
Figure 2A:
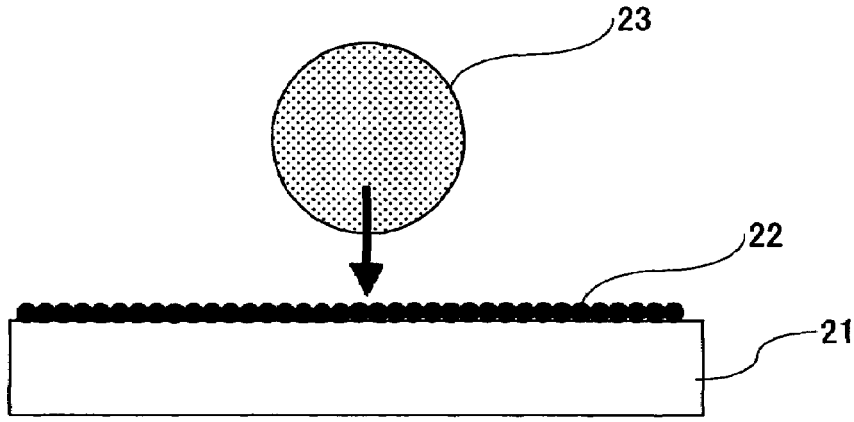
FIGS. 2A, 2B, and 2C are diagrams illustrating a fixing method of applying a non-aqueous fixing liquid onto a toner subjected to water repellency treatment on a recording medium in which a material for dissolving or swelling a toner is dissolved in a non-volatile non-aqueous solvent.
Figure 2B:
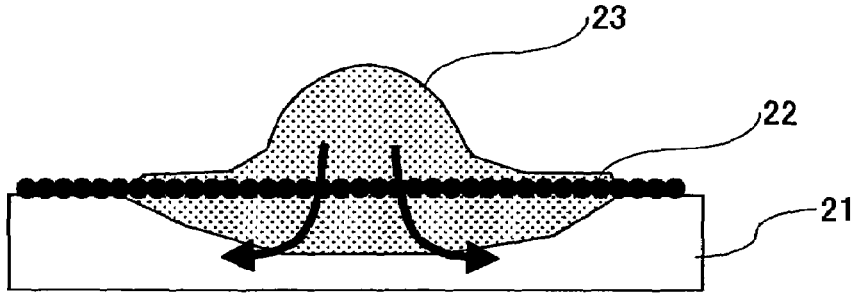
Figure 2C:
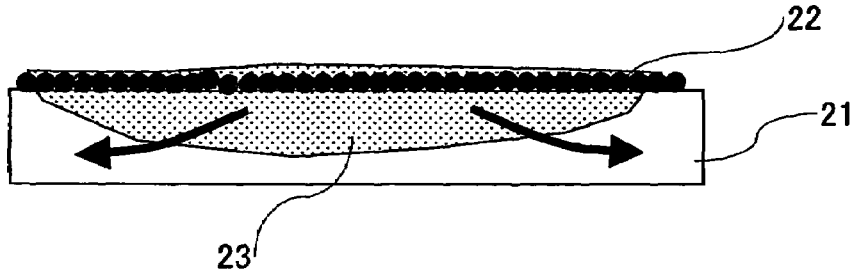

Next, the embodiment(s) of the present invention is/are described with reference to the drawings.

The first embodiment of the present invention is a fixing liquid which fixes a toner containing a resin on a recording medium, characterized in that a fluid particle containing a component which dissolves or swells at least a portion of the resin contained in the toner is dispersed in a dispersive medium, as a micro-emulsion.

The toner contains a resin such as a binder resin and a releasing agent. The resin contained in the toner is not particularly limited, in which as a preferable binder resin, for example, polystyrene resins, styrene-acryl copolymer resins, and polyester resins can be provided and as a releasing agent, for example, wax components such as polyethylene can be provided. The toner may further contain, for example, a coloring agent, a charge control agent, a fluidizing agent, and an external additive, which are publicly known, as well as the binder resin. Also, the toner is preferably subjected to water repellency treatment by fixing a hydrophobic fine particle such as a hydrophobic silica and a hydrophobic titanium oxide which have a methyl group, on the surface of a toner particle.

The recording medium is not particularly limited and, for example, a paper medium, a cloth medium, and a plastic film having a liquid penetrating layer such as an OHP sheet can be provided.

The component which dissolves or swells at least a portion of a resin contained in a toner is not limited if it is a component which can dissolve or swell at least a portion of a resin contained in a toner so that the toner is fixed on a recording medium. Additionally, for simplicity, the component which dissolves or swells at least a portion of a resin contained in a toner is also called a toner softening agent below.

The fluid particle is a particle containing a toner softening agent and is not only a liquid particle but may also be a gel-like liquid particle or a particle of a semi-solid such as waxes. When the fluid particle is liquid, the viscosity of the fluid particle is preferably equal to or greater than 1 mPa·sec and equal to or less than 1 mPa·sec. If the viscosity of the fluid particle is less than 1 mPa·sec or greater than 1 Pa·sec, the viscosity of the fluid particle it too low or too high, so that the use of the fluid particle in the fixing liquid is not easy.

The dispersive medium is a liquid dispersive medium which can disperse a fluid particle containing a toner softening agent as a micro-emulsion, and is either an aqueous dispersive medium or a non-aqueous dispersive medium. Herein, the aqueous dispersive medium is a dispersive medium whose solubility in water at room temperature (20° C.) is equal to or less than 90% by weight. Also, the non-aqueous dispersive medium is a dispersive medium whose solubility in water at room temperature (20° C.) is equal to or less than 1% by weight. When the dispersive medium is an aqueous dispersive medium, the solubility of a toner softening agent in water is preferably 0.1% by weight or less, that is, it is preferably non-aqueous.

The micro-emulsion is generally a dispersion system in which an oil-phase or aqueous-phase fine particle with a size of approximately several nm to several hundreds nm is dispersed in an aqueous phase or oil-phase dispersive medium due to the capability of surface activation of the dispersive medium. Particularly, in the micro-emulsion, a fine particle which is smaller than that of a usual emulsion self-disperses and the dispersive medium itself acts as a substance having a surface activation property (a cosurfactant) and stabilize the fine particle. Therefore, a surfactant for stabilizing a fluid particle in a dispersive medium is not necessarily required for the micro-emulsion. Also, the micro-emulsion provides a stability and a preservability which are higher than those of a usual emulsion, since a fluid particle is stabilized by a dispersive medium.

When an oil-phase fine particle is dispersed in an aqueous-phase dispersive medium, the micro-emulsion is called an oil-in-water type or micellar structure micro-emulsion. On the other hand, when an aqueous-phase fine particle is dispersed in an oil-phase dispersive medium, the micro-emulsion is called a water-in-oil type or reversed micellar structure micro-emulsion.

The micro-emulsion is different from a usual solution and an aqueous phase and an oil-phase are not dissolved in and still remain being separated from each other at the viewpoint of molecular level. The micro-emulsion is also different from a usual emulsion (a dispersion system in which a particle with a size of approximately several micron is dispersed in a dispersive medium), and is not a clouded system but a clear system (which may take on slightly pale-blue due to slight light scattering caused by a fine particle), so as to provide an appearance like an oil phase and an aqueous phase which are dissolved in each other.

Therefore, the micro-emulsion is usually clear on a visual observation and the measurement of turbidity based on light transmittance can distinguish a micro-emulsion and a solution from a usual emulsion but cannot distinguish a micro-emulsion from a solution. For the measurement of the particle size distribution of fine particles dispersing in the micro-emulsion, a scattering method such as a light scattering method and a small-angle X-ray scattering method is used. Due to the measurement of the particle size distribution of fine particles by using such a scattering method, a micro-emulsion can be distinguished from a solution. Herein, the inventors measured the particle size distribution of fine particles dispersing in a micro-emulsion by using a Doppler light scattering method and obtained the number-average particle diameter of fine particles dispersing in the micro-emulsion.

As a method for dispersing a fluid particle containing an toner softening agent in a dispersive medium, a fixing liquid according to the first embodiment of the present invention can be obtained by mixing a material containing a toner softening agent into a dispersive medium and mechanically stirring an obtained mixture or applying vibration to an obtained mixture. For example, a mechanically stirring device such as a homomixer and a homogenizer and a device for applying vibration such as an ultrasonic wave homogenizer can be provided. Particularly, it is desirable to use a vibratory strongly-stirring device such as a mechanical homogenizer, a homomixer, and an ultrasonic wave homogenizer in order to make the particle diameter of a fluid particle containing a toner softening agent be equal to or greater than 1 nm and equal to or less than 100 nm.

According to the first embodiment of the present invention, a fixing liquid capable of fixing a toner on a recording medium more efficiently can be provided.

For example, since a fixing liquid according to the first embodiment of the present invention has a good wettability to a toner even if any of aqueous and non-aqueous dispersive media is used, a defect in an image formed by a toner provided on a recording medium can be reduced which can be caused by the application of a fixing liquid when the fixing liquid is applied onto the toner provided on the recording medium.

Also, for example, in the fixing liquid according to the first embodiment of the present invention, since a toner softening agent is not dissolved in a solvent and a fluid particle containing a toner softening agent is dispersed in a dispersive medium as a micro-emulsion containing a fine particle which is smaller than a particle dispersed in a usual emulsion, more fine fluid particles containing a toner softening agent are dispersed in a dispersive medium and the more fine fluid particles can act on a toner provided on a recording medium. Thus, the total contact area of the fluid particles containing a toner softening agent to the toner provided on the recording medium can be increased.

As a result, while the dispersive medium permeates into the recording medium or passes through the recording medium, the fluid particles containing a toner softening agent do not permeate into the recording medium or pass through the recording medium but are concentrated so as to increase the probability of contacting the toner provided on the recording medium. In this case, since a probability is also increased such that the toner softening agent contained in the fluid particle does not permeate into the recording medium or pass through the recording medium but acts on the toner provided on the recording medium, the toner softening agent can effectively act on the toner provided on the recording medium so as to effectively dissolve or swell at least a portion of a resin contained in the toner. Accordingly, the toner provided on the recording medium can be fixed at a high speed and, as a result, the fixation responsibility of the toner provided on the recording medium can be improved.

Also, the quantity of a toner softening agent in a fixing liquid can be reduced. Further, waste in consumption of a toner fixing agent can be reduced.

In addition, in the fixing liquid according to the first embodiment of the present invention, since the fluid particle is a micro-emulsion fine particle which is smaller than a particle dispersed in a usual emulsion, more fine fluid particles can act on a toner provided on a recording medium. Therefore, a toner softening agent contained in the fluid particle can more uniformly act on the toner provided on the recording medium. As a result, the toner provided on the recording medium can be more uniformly fixed. That is, ununiformity of fixation of the toner provided on the recording medium can be reduced or eliminated.

Further, since the fixing liquid according to the first embodiment of the present invention is a micro-emulsion in which a fine fluid particle is dispersed in a dispersive medium, a toner softening agent contained in the fine fluid particle has been reduced. Accordingly, it can be reduced for an excess toner softening agent to dissolve or swell a toner provided on a recording medium too much and it can be reduced for fluidized toner to permeate into the recording medium and to cause disturbance (bleeding) of an image formed by the toner provided on the recording medium. That is, an image formed by the toner can be fixed on the recording medium well.

In the fixing liquid according to the first embodiment of the present invention, the fluid particle is preferably liquid. When the fluid particle containing a toner softening agent is a liquid particle, the fixing liquid is a micro-emulsion in which a liquid particle is dispersed in a dispersive medium. In this case, since the fluid particle containing a toner softening agent is a liquid particle, the liquid particle containing a toner softening agent can more easily act on a toner provided on a recording medium so as to fix the toner provided on the recording medium at a higher speed.

In the fixing liquid according to the first embodiment of the present invention, the fluid particle is preferably composed of a single phase containing a component for dissolving or swelling at least a portion of a resin contained in the toner (a toner softening agent).

When the fluid particle is composed of a single phase containing a toner softening agent and the fluid particle containing a toner softening agent is an aqueous fluid particle, the fixing liquid is a water-in-oil (W/O) type micro-emulsion in which the aqueous fluid particle is dispersed in a non-aqueous dispersive medium. Alternatively, when it is composed of a single phase containing a toner softening agent and the fluid particle containing a toner softening agent is a non-aqueous fluid particle, the fixing liquid is an oil-in-water (O/W) type micro-emulsion in which the non-aqueous fluid particle is dispersed in an aqueous dispersive medium or an oil-in-oil (O/O) type micro-emulsion in which the non-aqueous fluid particle is dispersed in a non-aqueous dispersive medium.

When the fluid particle is composed of a single phase containing a component for dissolving or swelling at least a portion of a resin contained in the toner (a toner softening agent), the fluid particle containing a toner softening agent can be stably dispersed in a dispersive medium.

In the fixing liquid according to the first embodiment of the present invention, the number-average particle diameter of the fluid particle is equal to or greater than 1 nm and equal to or less than 100 nm.

Herein, for the measurement of the number average particle diameter of the fluid particle containing a toner softening agent, a scattering method such as a light scattering method and a small angle X-ray scattering method is used. Additionally, the inventors measured the particle size distribution of fine particles dispersed in an micro-emulsion by using a Doppler light scattering method which utilizes scattered laser light (Tyndall phenomenon) so as to obtain the number average particle diameter of the fine particles dispersed in the micro-emulsion.

First, in the fixing liquid according to the first embodiment of the present invention, the number average particle diameter of the fluid particle is preferably equal to or less than 100 nm in order to form a micro-emulsion. When the number average particle diameter of a particle containing a toner softening agent is equal to or less than 100 nm and when the fixing agent according to the first embodiment of the preset invention is applied to a toner provided on a recording medium, a probability is increased such that a toner softening agent does not pass among toner particles provided on the recording medium or permeate into the recording medium or pass through the recording medium but adheres to the toner particle provided on the recording medium. As a result, since the probability of acting on the toner provided on the recording medium is also increased, the toner softening agent can act on the toner provided on the recording medium more effectively. Accordingly, the toner provided on the recording medium can be fixed at a higher speed. Also, the quantity of the toner softening agent can be further reduced and waste in consumption of the toner softening agent can be further reduced. Further, ununiformity in fixation of the toner provided on the recording medium can be reduced or eliminated.

Next, in the fixing liquid according to the first embodiment of the present invention, the number average particle diameter of the fluid particle is preferably equal to or greater than 1 nm.

When the number average particle diameter of a particle containing a toner softening agent is less than 1 nm and when the fixing agent according to the first embodiment of the preset invention is applied to a toner provided on a recording medium, the toner softening agent may easily pass among toner particles with a dispersive medium or easily penetrate into the recording medium or easily pass through the recording medium so that it may be difficult for the fluid particle to efficiently adhere onto the toner particle provided on the recording medium. As a result, it may be difficult for the toner softening agent to act on the toner provided on the recording medium.

In the fixing liquid according to the first embodiment of the present invention, the dispersive medium preferably includes an alcohol.

When the dispersive medium includes an alcohol, the dispersive medium is an aqueous dispersive medium. The alcohol may be one kind of alcohol or a mixture of plural kinds of alcohols. Also, the alcohol may be a monovalent alcohol or a polyvalent alcohol. As a monovalent alcohol, for example, ethanol can be provided. Also, as a polyvalent alcohol, for example, ethylene glycol, diethylene glycol, propylene glycol, 1,3-butanediol (1,3-butylene glycol), and glycerin can be provided.

The inventors have found that, when the solubility of a toner softening agent in water is equal to or less than 0.1%, that is, it is non-aqueous, the alcohol as a dispersive medium itself functions as a substance having a surface activation property (cosurfactant) such that a stable micro-emulsion can be easily formed.

In the fixing liquid according to the first embodiment of the present invention, the alcohol preferably includes propylene glycol or 1,3-butanediol.

Popylene glycol and 1,3-butanediol have an extremely high safety to a human body and can provide a dispersive medium which generates no unpleasant odor.

In the fixing liquid according to the first embodiment of the present invention, the alcohol preferably includes propylene glycol.

In particular, when the alcohol includes propylene glycol, a fixing liquid with a safety to a human body can be provided since propylene glycol is an extremely safe material for a human body. In addition, propylene glycol has a gradual vaporization property. If the dispersive medium was a completely non-volatile material, the dispersive medium would permanently remain on a recording medium after the fixing liquid was applied on the recording medium. As a result, the writing characteristic of a recording medium with a fixed toner or the hand contact feeling thereof might be degraded. Therefore, it is desirable that the dispersive medium gradually vaporizes from a recording medium. When the alcohol includes propylene glycol, a recording medium with a fixed toner can provided a good writing characteristic or hand contact feeling since propylene glycol has a gradual vaporization property. On the other hand, a volatile organic compound may be problematic with respect to the influence thereof to a human body. However, propylene glycol has an extremely high safety and the gradual vaporization of propylene glycol causes no problem. Also, since propylene glycol as a dispersive medium gradually vaporizes, it is easy to stably store the fixing liquid even if the fixing liquid is left in the atmospheric air.

In the fixing liquid according to the first embodiment of the present invention, the alcohol preferably includes ethanol.

When the alcohol includes ethanol, a fixing liquid which is safe for a human body can be provided since ethanol is an extremely safe material for a human body and an only material which can be used in an office environment, among volatile organic compounds. Also, ethanol is a material exhibiting an excellent permeability into each kind of porous material and a dispersive medium having an excellent permeability into a recording medium and a toner provided on the recording medium. Then, since ethanol as a dispersive medium more rapidly passes through a recording medium or a toner provided on the recording medium, a fluid particle contained in the fixing liquid more easily adheres to or remains on the toner provided on the recording medium. As a result, a toner softening agent contained in the fluid particle can more easily act on the toner provided on the recording medium so that the fixation speed of the fixing liquid can be improved.

In the fixing liquid according to the first embodiment of the present invention, the dispersive medium preferably includes an n-alkane.

When the dispersive medium includes an n-alkane, an n-alkane particularly has a high affinity to a toner subjected to water repellency treatment and, therefore, the toner subjected to water repellency treatment can be significantly wetted. That is, an n-alkane which is a paraffinic dispersive medium has a low surface tension equal to or less than 25 mN/m and has a high affinity to a toner subjected to water repellency treatment.

As a result, when the fixing liquid according to the first embodiment of the present invention is applied to a toner subject to water repellence treatment on a recording medium, the disturbance of an image formed by the toner subjected to water repellency treatment can be reduced. For example, decane, dodecane, undecane, and tridecane, have lower volatilities among n-alkanes, and when a liquid drop containing any of decane, dodecane, undecane, and tridecane, as a non-aqueous dispersive medium, is applied to a toner subjected to water repellency treatment on a recording medium, the disturbance of an image formed by the toner subjected to water repellency treatment is seldom caused.

In the fixing liquid according to the first embodiment of the present invention, the dispersive medium preferably includes a dimethylsilicone.

When the dispersive medium includes a dimethylsilicone, a toner subjected to water repellency treatment can be significantly wetted since a dimethylsilicone particularly has a high affinity to a toner subjected to water repellency treatment. That is, a dimethysilicone which is a silicone-based dispersive medium has a low surface tension of approximately 20 mN and has a high affinity to a toner subjected to water repellency treatment.

As a result, when the fixing liquid according to the first embodiment of the present invention is applied to a toner subjected to water repellency treatment on a recording medium, the disturbance of an image formed by the toner subjected to water repellency treatment can be reduced.

Also, a dimetylsilicone provides no odor and the safety thereof to a human body is high. Therefore, a dimethylsilicone as a dispersive medium can provide a fixing liquid providing no odor and a safety to a human body. Particularly, a dimethylsilicone having a viscosity equal to or greater than 3 mPa·sec has lower volatility.

Also, when a liquid drop containing a dimethylsilicone as a dispersive medium is applied to a toner subjected to water repellency treatment on a recording medium, the disturbance of an image formed by the toner subjected to water repellency treatment is seldom caused.

In the fixing liquid according to the first embodiment of the present invention, the dispersive medium preferably includes no water.

If the dispersive medium for the fixing liquid contained water and the rate of water in the dispersive medium was high, pulp fibers in paper would be disintegrated and cockling of paper would be easily caused when a recording medium was paper. It is most desirable for the dispersive medium to contain water (the content of water in the dispersive medium is 0%) and the generation of paper cockling can be reduced. Additionally, when the dispersive medium for the fixing liquid contains water, it is desirable that the content of water in the dispersive medium is equal to or less than 20%.

In the fixing liquid according to the first embodiment of the present invention, preferably, the surface tension of the dispersive medium is equal to or greater than 20 mN/m and equal to or less than 40 mN/m and/or the surface tension of the fluid particle is equal to or greater than 20 mN/m and equal to or less than 40 mN/m. Also, in the fixing liquid according to the first embodiment of the present invention, the surface tension of the fixing liquid is preferably equal to or greater than 20 mN/m and equal to or less than 40 mN/m.

Herein, each of the surface tension of the dispersive medium and the surface tension of the fluid particle is a value at an ordinary temperature (room temperature: 20° C.) and an ordinary pressure (atmospheric pressure). Also, the surface tension of the dispersive medium and the surface tension of the fluid particle is measured by, for example, a plate method (Whilhelmy method) using a platinum plate.

It is preferable that the dispersive medium and/or the fluid particle have/has an affinity to a toner provided on a recording medium. Herein, the affinity means the degree of spread wetting of a liquid on the surface of a solid when the liquid contacts the solid. Therefore, in other words, it is preferable that the dispersive medium and/or the fluid particle have/has wettability to a toner provided on a recording medium.

The affinity (wettability) of the dispersive medium and/or the fluid particle to a toner provided on a recording medium is evaluated based on the value of a receding contact angle of a liquid drop of the dispersive medium and/or the fluid particle which are/is applied on a plane surface of a flat plate made of the resin of a toner provided on a recording medium. When the value of the receding contact angle is equal to or less than 1 degree, the dispersive medium and/or the fluid particle have/has affinity (wettability) to the toner provided on the recording medium. On the other hand, when the value of the receding contact angle is greater than 1 degree, the dispersive medium and/or the fluid particle do/does not have affinity (wettability) to the toner provided on the recording medium.

The surface of a toner subjected to a water repellency treatment which uses a hydrophobic fine particle such as a hydrophobic silica and a hydrophobic titanium oxide is covered with a methyl group of a hydrophobic silica or a hydrophobic titanium oxide and has a surface energy of approximately 20 mN/m. Since all the surface of a toner subjected to a water repellency treatment is not completely covered with a hydrophobic fine particle, the surface energy of a toner subjected to a water repellency treatment is estimated to be approximately 20 mN/m-40 mN/m. Therefore, in order to have affinity (wettability) to a toner subjected to a water repellency treatment, it is preferable that the surface tension(s) of the dispersive medium and/or the fluid particle and/or the surface tension of the fixing liquid are/is equal to or greater than 20 mN/m and equal to or less than 40 mN/m. As such a dispersive medium, for example, fluorinated oils, paraffinic dispersive media, olefinic dispersive media, and silicone-based dispersive media can be provided.

Also, in a fixing liquid in which a fluid particle containing a toner softening agent is dispersed in a dispersive medium as a micro-emulsion, there is a possibility such that the fluid particle containing a toner softening agent does not adhere to a toner provided on a recording medium but easily pass among particles of a toner provided on a recording medium or easily pass through the recording medium such as through a pulp fiber opening of paper, since the particle diameter of the fluid particle containing a toner softening agent is small (approximately 1 nm-100 nm).

Therefore, it is preferable that the fluid particle has affinity to a toner provided on a recording medium. In this case, the fluid particle containing a toner softening agent easily adheres to the surface of the toner provided on the recording medium. As a result, the fluid particle containing a toner softening agent is more easily concentrated and remains on the surface of the toner provided on the recording medium. Then, the toner softening agent can more easily act on the toner provided on the recording medium so as to fix the toner on the recording medium more easily. Also, when the fluid particle has affinity to a toner provided on a recording medium and when the fixing liquid is applied to the toner provided on the recording medium, the fluid particle contained in the fixing liquid can locally act on a portion of the toner provided on the recording medium on which portion the fixing liquid is applied while the dispersive medium contained in the fixing liquid spreads out on the recording medium. That is, the portion of the toner provided on the recording medium on which portion the fixing liquid is applied can be locally fixed. On the contrary, in regard to a fixing liquid which is a solution containing a toner softening agent, when the fixing agent spreads out on a toner provided on a recording medium, not only a solvent but also the toner softening agent spreads out on the toner provided on the recording medium and all the portion of the toner provided on the recording medium is fixed on which portion the fixing liquid spreads out, but when the concentration of the softening agent in the fixing liquid is low, the softening agent diffuses in the recording medium so that the fixation property is lowered.

Also, it is preferable that the dispersive medium has affinity to a toner provided on a recording medium. In this case, when the fixing liquid containing the dispersive medium is applied on a toner provided on a recording medium, since the dispersive medium has affinity to the toner provided on the recording medium, the fixing liquid also has affinity to the toner provided on the recording medium and the fixing liquid is not repelled by the toner provided on the recording medium and can adhere to the toner provided on the recording medium.

Additionally, the fluid particle contains a toner softening agent, that is, a component for dissolving or swelling at least a portion of a resin contained in a toner and, accordingly, often has affinity to a toner provided on a recording medium.

In the fixing liquid according to the first embodiment of the present invention, the content of the fluid particle in the dispersive medium is preferably equal to or greater than 0.5% by weight and equal to or less than 50% by weight. More preferably, the content of the fluid particle in the dispersive medium is equal to or greater than 1% by weight and equal to or less than 10% by weight.

When the content of the fluid particle in the dispersive medium is less than 0.5% by weight, it may be difficult to dissolve or swell at least a portion of a resin contained in a toner and it may be difficult to sufficiently fix the toner on a recording medium. On the other hand, when the content of the fluid particle in the dispersive medium is greater than 50% by weight, at least a portion of a resin contained in a toner is much dissolved or swelled so that the fluidity of the toner cannot be lowered over a long period of time, and a toner layer on which the fixing liquid is applied may have a stickness over a long period of time. Therefore, when the content of the fluid particle in the dispersive medium is equal to or greater than 0.5% by weight and equal to or less than 50% by weight, ay least a portion of a resin contained in a toner can be appropriately dissolved or swelled and the toner can be fixed on a recording medium well.

The fixing liquid according to the first embodiment of the present invention preferably further includes a surfactant.

When the dispersive medium is an aqueous dispersive medium and has a high surface tension, the surface tension of the dispersive medium can be lowered by containing a surfactant in the fixing liquid. In this case, the surface tension of the fixing liquid containing the dispersive medium can be lowered and the fixing liquid can have affinity to a toner subjected to water repellency treatment. As a result, a fluid particle containing a softening agent can easily adhere to the surface of a toner provided on a recording medium. Then, the toner softening agent can more easily act on the toner provided on the recording medium so that the toner can be more easily fixed on the recording medium. For example, when a dispersive medium of polyvalent alcohol having a surface tension higher than that of a dispersive medium of monovalent alcohol, it is preferable to add a surfactant into the fixing liquid so as to lower the surface tension of the dispersive medium.

In the fixing liquid according to the first embodiment of the present invention, the HLB value of the surfactant is preferably equal to or greater than 10.

When the HLB (hydrophile-lipophile balance) value of the surfactant is equal to or greater than 10, affinity to a toner subjected to water repellency treatment can be provided to the fixing liquid containing an aqueous dispersive medium. Herein, the HLB value is, for example, a value calculated by using a formula of

*HLB* value=20×(molecular weight of hydrophilic group in surfactant)/(molecular weight of surfactant), which is known as Griffin formula. As a surfactant with a HLB value equal to or greater than 10, for example, polyoxyalkyl-modified silicones with a HLB value equal to or geater then 13 can be provided.

In the fixing liquid according to the first embodiment of the present invention, the component for dissolving or swelling at least a portion of a resin contained in a toner (toner softening agent) preferably includes an aliphatic ester.

It is preferable that the toner softening agent includes an aliphatic ester since an aliphatic ester is excellent in the dissolving property or swelling property thereof for dissolving or swelling at least a portion of a resin contained in a toner.

Also, in regard to the toner softening agent, it is preferable that the acute oral toxicity $LD_{50}$ thereof is greater than 3 g/kg, from the viewpoint of safety to a human body. The safety of the aliphatic ester to a human body is high such that it is frequently used as a raw material for cosmetics.

Further, since the fixation of a toner on a recording medium is conducted in an instrument which is frequently used in a closed environment and the toner softening agent remains in the toner even after the fixation of the toner on the recording medium, it is preferable that the fixation of the toner on the recording medium involves no generation of a volatile organic compound (VOC) or unpleasant odor. That is, it is preferable that the toner softening agent contains no volatile organic compound (VOC) or no material which causes the generation of unpleasant odor. An aliphatic ester has a high boiling point and a low volatility and has no irritating odor, compared to a commonly used organic solvent (toluene, xylene, methyl ethyl ketone, ethyl acetate, etc.). Also, an aliphatic ester has an advantage of causing no contamination of water quality.

Herein, as a practical measure for odor measurement which can measure odor with a high precision in, for example, an office environment, an odor intensity index (10×log (dilute strength of a substance at which the odor of the substance cannot be sensed)) based on a triangle odor bag method that is a sensory measurement can be an index of odor intensity.

It is preferable that the odor intensity index of an aliphatic ester contained in the toner softening agent is equal to or less than 10. In this case, unpleasant odor is not sensed in a usual office environment.

Additionally, it is preferable that not only the toner softening agent but also a material such as a dispersive medium contained in the fixing liquid has no unpleasant odor or no irritating odor. Further, since the content of the dispersive medium in the fixing liquid is high, the odor intensity index of the dispersive medium is preferably equal to or less than 7, and more preferably, equal to or less than 3.

In the fixing liquid according to the first embodiment of the present invention, the aliphatic ester preferably includes a saturated aliphatic ester.

When the aliphatic ester includes a saturated aliphatic ester, the preservation stability of the toner softening agent (the resistance thereof to, for example, oxidation or hydrolysis) can be improved. Also, the safety of a saturated aliphatic ester to a human body is high and many of saturated aliphatic esters can dissolve or swell a resin contained in a toner within one second. Further, since it is considered that a saturated aliphatic ester forms an oil membrane on the surface of a dissolved or swelled toner, a saturated aliphatic ester can reduce the stickiness of a toner provided on a recording medium after a dispersive medium permeates into the recording medium or evaporates from the recording medium.

In the fixing liquid according to the first embodiment of the present invention, the saturated aliphatic ester preferably includes a compound represented by a general formula of $$R_1COOR_2,$$

in which $R_1$ is an alkyl group whose carbon number is equal to or greater than 11 and equal to or less than 14 and $R_2$ is an alkyl group whose carbon number is equal to or greater than 1 and equal to or less than 3.

When the saturated aliphatic ester includes a compound represented by a general formula of $R_1COOR_2$, in which $R_1$ is an alkyl group whose carbon number is equal to or greater than 11 and equal to or less than 14 and $R_2$ is an alkyl group whose carbon number is equal to or greater than 1 and equal to or less than 3, the dissolving property or swelling property thereof for a resin contained in a toner can be improved. Also, the odor intensity index of the compound described above is equal to or less than 10 and the compound described above has no unpleasant odor or no irritating odor.

Figure 3:
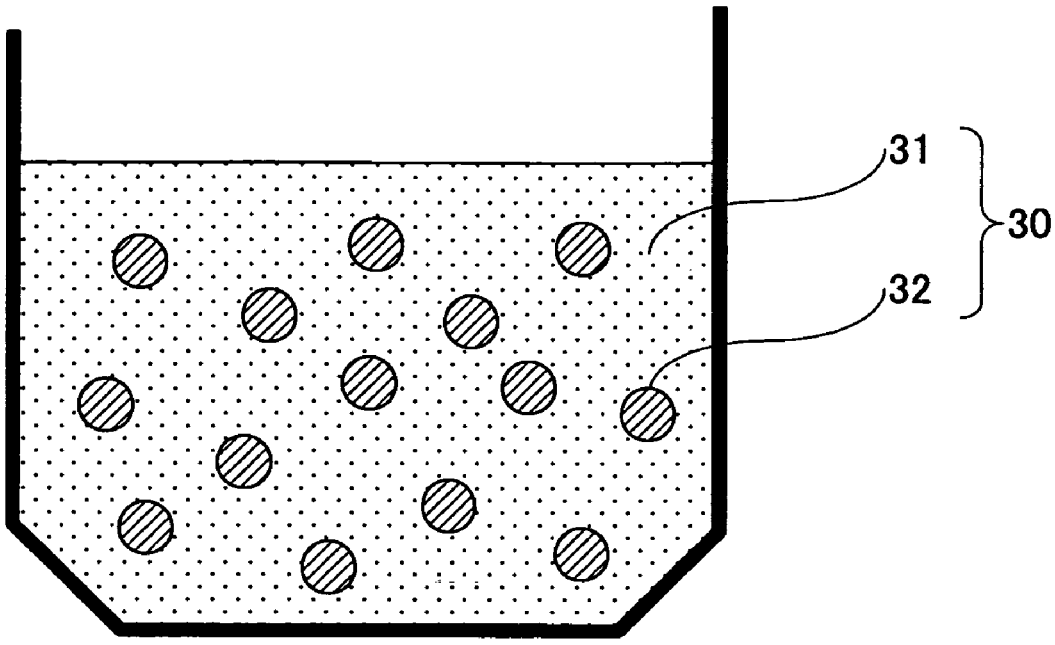
FIG. 3 is a diagram illustrating one example of a fixing liquid according to the present invention.

As an aliphatic monocarboxylate ester which is the compound described above, for example, ethyl laurate, hexyl laurate, ethyl tridecylate, isopropyl tridecylate, ethyl myristate, and isopropyl myristate can be provided. Many of these aliphatic monocarboxylate esters which are the compounds described above can be dissolved in a non-aqueous dispersive medium but cannot be dissolved in an aqueous dispersive medium. Therefore, in regard to many of the aliphatic monocarboxylate esters which are the compounds described above, for example, a micro-emulsion can be obtained, that is, the fixing liquid according to the first embodiment of the present invention can be obtained, by dispersing a fluid particle made of an aliphatic monocarboxylate ester which is the compound described above in an aqueous dispersive medium. Thus, as shown in FIG. 3, a fixing liquid can be obtained as a micro-emulsion in which liquid a fluid particle as a toner softening agent which is made of an aliphatic monocarboxylate ester is dispersed in an aqueous dispersive medium.

In the fixing liquid according to the first embodiment of the present invention, the aliphatic ester preferably includes an aliphatic dicarboxylate ester.

When the aliphatic ester includes an aliphatic dicarboxylate ester, a resin contained in a toner can be dissolved or swelled for a shorter time period. For example, for high speed character printing of approximately 600 ppm, it is desirable that a time period for which a fixing liquid is provided to an unfixed toner on a recording medium and the toner fixes on the recording medium is within 1 second. When the aliphatic ester includes an aliphatic dicarboxylate ester, a time period required for providing a fixing liquid to an unfixed toner on a recording medium and fixing the toner on the recording medium can be within 1 second. Further, since a resin contained in a toner can be dissolved or swelled by addition of a smaller quantity of a toner softening agent, the content of a toner softening agent contained in the fixing liquid can be reduced.

In the fixing liquid according to the first embodiment of the present invention, the aliphatic dicarboxylate ester preferably includes a compound represented by a general formula of $$R_3(COOR_4)_2,$$

in which $R_3$ is an alkylene group whose carbon number is equal to or greater than 3 and equal to or less than 8 and $R_4$ is an alkyl group whose carbon number is equal to or greater than 2 and equal to or less than 5.

When the aliphatic dicarboxylate ester includes a compound represented by a general formula of $R_3(COOR_4)_2$, in which $R_3$ is an alkylene group whose carbon number is equal to or greater than 3 and equal to or less than 8 and $R_4$ is an alkyl group whose carbon number is equal to or greater than 2 and equal to or less than 5, the dissolving property or swelling property thereof for a resin contained in a toner can be improved. Also, the odor intensity index of the compound described above is equal to or less than 10 and the compound described above has no unpleasant odor or no irritating odor.

As an aliphatic dicarboxylate ester which is the compound described above, for example, diethyl succinate, diethyl adipate, diisobutyl adipate, diisopropyl adipate, diisodecyl adipate, diethyl sebacate, and dibutyl sebacate can be provided. Many of these aliphatic dicarboxylate esters which are the compounds described above can be dissolved in a non-aqueous dispersive medium but cannot be dissolved in an aqueous dispersive medium. Therefore, in regard to many of the aliphatic dicarboxylate esters which are the compounds described above, for example, a micro-emulsion can be obtained, that is, the fixing liquid according to the first embodiment of the present invention can be obtained, by dispersing a fluid particle made of an aliphatic dicarboxylate ester which is the compound described above in an aqueous dispersive medium. Therefore, as shown in FIG. 3, a fixing liquid can be obtained as a micro-emulsion in which liquid a fluid particle made of an aliphatic dicarboxylate ester as a toner softening agent is dispersed in an aqueous medium.

In the fixing liquid according to the fist embodiment of the present invention, the aliphatic ester preferably includes a dialkoxyalkyl aliphatic dicarboxylate.

When the aliphatic ester includes a dialkoxyalkyl aliphatic dicarboxylate, the fixation property of a toner on a recording medium can be improved.

In the fixing liquid according to the first embodiment of the present invention, the dialkoxyalkyl aliphatic dicarboxylate preferably includes a compound represented by a general formulaof $$R_5(COOR_6—O—R_7)_2,$$

in which $R_5$ is an alkylene group whose carbon number is equal to or greater than 2 and equal to or less than 8, $R_6$ is an alkylene group whose carbon number is equal to or greater than 2 and equal to or less than 4, and $R_7$ is an alkyl group whose carbon number is equal to or geater than 1 and equal to or less than 4.

When the dialkoxyalkyl aliphatic dicarboxylate includes a compound represented by a general formula of $R_5(COOR_6—O—R_7)_2$, in which $R_5$ is an alkylene group whose carbon number is equal to or geater than 2 and equal to or less than 8, $R_6$ is an alkylene group whose carbon number is equal to or geater than 2 and equal to or less than 4, and $R_7$ is an alkyl group whose carbon number is equal to or geater than 1 and equal to or less than 4, the dissolving property or swelling property thereof for a resin contained in a toner can be improved. Also, the odor intensity index of the compound described above is equal to or less than 10 and the compound described above has no unpleasant odor or no irritating odor.

As a dialkoxyalkyl aliphatic dicarboxylate which is the compound described above, for example, diethoxyethyl succinate, dibutoxyethyl succinate, diethoxyethyl adipate, dibutoxyethyl adipate, and diethoxyethyl sebacate can be provided. Many of these dialkoxyalkyl aliphatic dicarboxylates which are the compounds described above are slightly soluble in water (slightly aqueous). Therefore, in regard to many of the dialkoxyalkyl aliphatic dicarboxylates which are the compounds described above, for example, a micro-emulsion can be obtained, that is, the fixing liquid according to the first embodiment of the present invention can be obtained, by directly dispersing a fluid particled made of a dialkoxyalkyl aliphatic dicarboxylate which is the compound described above in a non-aqueous medium. Thus, as shown in FIG. 3, a fixing liquid can be obtained as a micro-emulsion in which liquid a fluid particle made of a dialkoxyalkyl aliphatic dicarboxylate as a toner softening agent is dispersed in a non-aqueous dispersive medium.

FIG. 3 is a diagram illustrating one example of a fixing liquid according to the present invention a fixing liquid 30 shown in FIG. 3 contains a dispersive medium 31 and fluid particles 32 which is not dissolved in the dispersive medium 31 and is composed of a single phase containing a toner softening agent. In the fixing liquid 30, the fluid particles 32 are dispersed in the dispersive medium 31. The fluid particle 32 is composed of only the toner softening agent. The dispersive medium 31 is either an aqueous dispersive medium or a non-aqueous dispersive medium. The aqueous dispersive medium may be, for example, a monovalent alcohol or a glycol, and the non-aqueous dispersive medium may be, for example, n-alkane, a dimethylsilicone, or an α-olefinic solvent. The toner softening agent may be, for example, an aliphatic ester which is not dissolved in the dispersive medium 31. Also, the fixing liquid 31 may contain a dispersing agent such as surfactants for stably dispersing the fluid particles 32 in the dispersive medium 31.

The second embodiment of the present invention is a toner fixing method which fixes a toner containing a resin on a recording medium, in which the fixing liquid according to the first embodiment of the present invention is used.

More particularly, in the toner fixing method according to the second embodiment of the present invention, the fixing liquid according to the first embodiment of the present invention is applied to a toner containing a resin on a recording medium whereby the toner containing a resin is fixed on the recording medium.

According to the second embodiment of the present invention, a toner fixing method which can fix a toner on a recording medium more efficiently can be provided.

FIGS. 4A, 4B, 4C and 4D are diagrams illustrating a specific example of a toner fixing method according to the present invention.

Figure 4A:
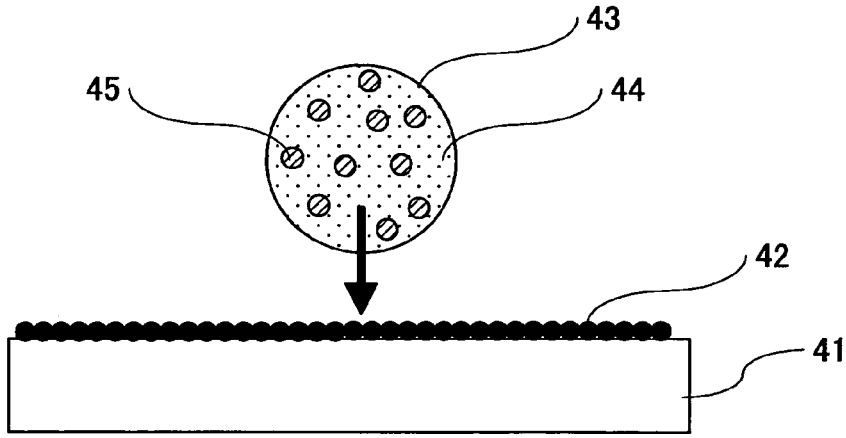
FIGS. 4A, 4B, 4C, and 4D are diagrams illustrating a specific example of a toner fixing method according to the present invention.

First, as shown in FIG. 4A, a fixing liquid 43 according to the first embodiment of the present invention is provided to a water-repellent toner 42 transcribed on a recording medium 41 by using an appropriate fixing liquid providing device such as an ink jet nozzle and a spray gun. The fixing liquid 43 contains liquid particles 45 which contain a toner softening agent dispersed in a dispersive medium 44 having a high affinity to the water-repellent toner 42 as a micro-emulsion. The liquid particles 45 have an affinity to the water-repellent toner 42 by containing a toner softening agent.

Figure 4B:
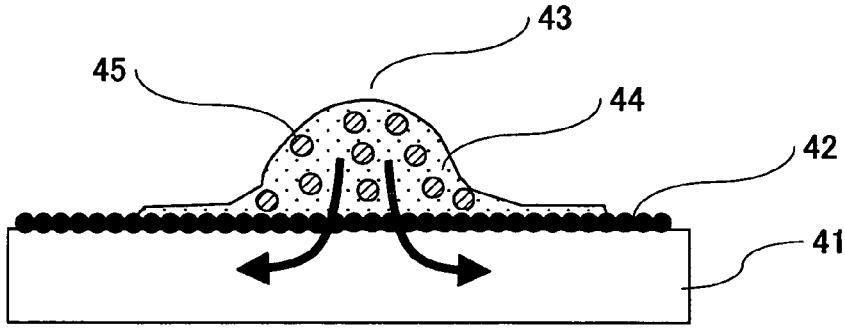

Then, as shown in FIG. 4B, when the fixing liquid 43 contacts the recording medium 41 and the water-repellent toner 42 transcribed on the recording medium 41, the water-repellent toner 42 is not repelled by the fixing liquid 43 and the disturbance of a layer of the water-repellent toner 42 transcribed on the recording medium 41 is seldom caused since the fixing liquid 43 mainly contains the dispersive medium 44 having a high affinity to the water-repellent toner 42. Then, the dispersive medium 44 contained in the fixing liquid 43 spreads out on the recording medium 41 and the layer of the water-repellent toner 42 transcribed on the recording medium 41.

Figure 4C:
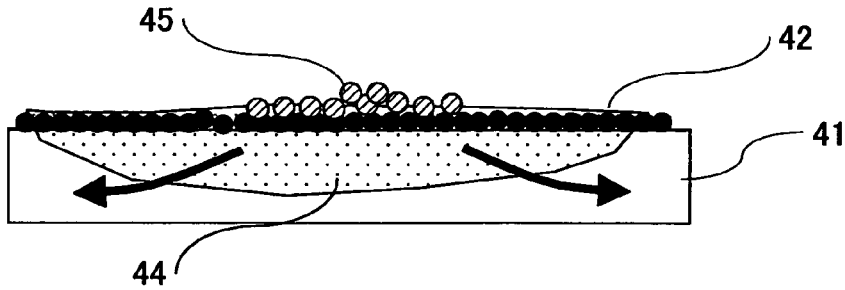

Then, as shown in FIG. 4C, while the dispersive medium 44 contained in the fixing liquid 43 passes through the space in the water-repellent toner 42 and permeates into the recording medium 41, the liquid particles 45 contained in the fixing liquid 43 do not pass through the space in the layer of the water-repellent toner 42 or through the recording medium 41 but adhere to the layer of the water-repellent toner 42. Herein, the liquid particles 45 adhere to a portion of the layer of the water-repellent toner 42 on which portion the fixing liquid 43 has been dropped. Therefore, when the dispersive medium 44 passes through the space in the layer of water-repellent toner 42 and permeates into the recording medium 41, the concentration of the liquid particles 45 contained in the fixing liquid 43, that is, the concentration of the toner softening agent increases.

Figure 4D:
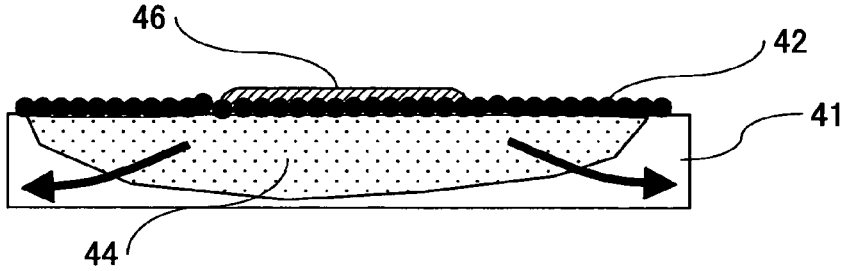

Finally, as shown in FIG. 4D, while the dispersive medium 44 sufficiently permeates into the recording medium 41, the plural liquid particles 45 are combined with one another and form a liquid layer 46 which contains the toner softening agent. The toner softening agent contained in the liquid layer 46 rapidly dissolves or swells the water-repellent toner 42. As a result, the layer of the water-repellent toner 42 becomes like a, film and is fixed on the recording medium 41.

Thus, even if the concentration of the toner softening agent in the dispersive medium 44 is low, the concentration of the toner softening agent-becomes high on the surface of the layer of the water-repellent toner 42 while the dispersive medium 44 permeates into the recording medium 41. Therefore, the content of the toner softening agent in the fixing liquid can be reduced. Also, most of the toner softening agent can act on the water-repellent toner 42 and the quantity of toner softening agent which permeates into the recording medium 41 is relatively low. Accordingly, the toner softening agent is not wastefully consumed.

Further, the fixing liquid 43 is a micro-emulsion and the liquid particles 45 are fine particles which are smaller than particles dispersed in a usual emulsion. Therefore, since the total contact surface area of the liquid particles 45 contacting the water-repellent toner 42 is greater, the toner softening agent contained in the liquid particles 45 can efficiently act on the water-repellent toner 42 and the fixation responsibility of the toner to the recording medium 41 can be improved. Also, since the liquid particles 45 are fine particles which are smaller than particles dispersed in a usual emulsion, more liquid particles 45 can more uniformly adhere to the water-repellent toner 42 and the toner softening agent contained in the liquid particles 45 can more uniformly act on the water-repellent toner 42. As a result, the water-repellent toner 42 provided on the recording medium 41 can be fixed more uniformly. In addition, since the liquid particles 45 are fine particles which are smaller than particles dispersed in a usual emulsion, it can be reduced for an excess toner softening agent to dissolve or swell the water-repellent toner 42 provided on the recording medium 41 too much and it can be reduced to cause the disturbance (bleeding) of an image formed by the water-repellent toner 42 provided on the recording medium 41. That is, the image formed by the water-repellent toner 42 can be fixed on the recording medium 41 well.

The third embodiment of the present invention is a toner fixing device in which a toner containing a resin is fixed on a recording medium by using the toner fixing method according to the second embodiment according to the present invention.

According to the third embodiment of the present invention, a toner fixing device can be provided which can fix a toner on a recording medium more efficiently.

A toner fixing device according to the third embodiment of the present invention has, for example, a fixing liquid container for storing the fixing liquid according to the first embodiment of the present invention, which liquid is used in the toner fixing method according to the second embodiment of the present invention, and an appropriate fixing liquid providing device for providing the fixing liquid to an unfixed toner provided on a recording medium, such as a liquid drop flight device such as a spray gun or an ink jet nozzle. Also, the toner fixing device may have a pair of smoothing rollers (hard rollers) for pressurizing a toner dissolved or swelled by a toner softening agent, after the fixing liquid according to the first embodiment of the present invention is provided to a toner. The dissolved or swelled toner is pressurized by a pair of the smoothing rollers (hard rollers), whereby the surface of a layer of the dissolved or swelled toner can be smoothed so as to provide the toner with the luster thereof. Also, the fixation property of the toner on the recording medium can be improved by forcing the dissolved or swelled toner to the recording medium.

Figure 5:
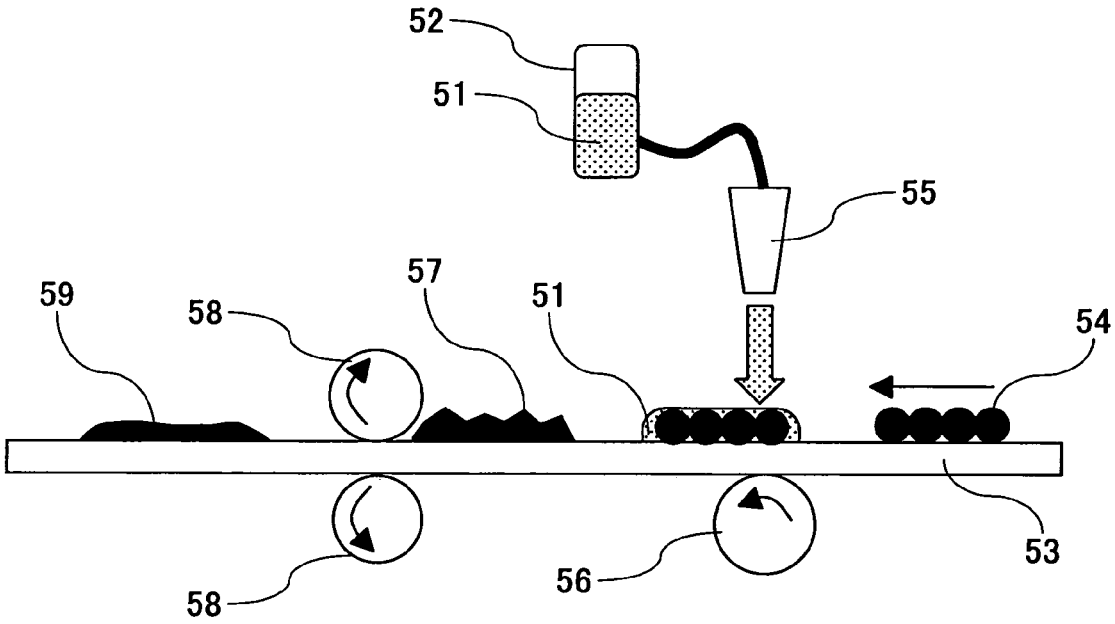
FIG. 5 is a diagram illustrating a specific example of a toner fixing device according to the present invention.

FIG. 5 is a diagram illustrating a specific example of a toner fixing device according to the present invention. The toner fixing device shown in FIG. 5 has a fixing liquid container 52 for storing a fixing liquid 51, a fixing liquid providing device 55 for providing the fixing liquid 51 to a toner 54 transcribed on a recording medium 53, such as a spray gun, a conveyance roller 56 for conveying the recording medium 53 on which the toner 54 is provided, and a pair of smoothing rollers 58 for pressurizing a toner 57 dissolved or swelled by the fixing liquid 51.

In the toner fixing device shown in FIG. 5, the recording medium 53 on which the toner 54 is provided is conveyed by the conveyance roller 56 and the fixing liquid 51 stored in the fixing liquid container 52 is provided to the toner 54 on the recording medium 53 by the fixing liquid providing device 55. As the fixing liquid 51 is provided to the toner 54 on the recording medium 53, the toner is dissolved or swelled by a toner softening agent contained in the fixing liquid 51. The toner 57 dissolved or swelled by the fixing liquid 51 is further conveyed by the conveyance roller 56 together with the recording medium 53. Then, the toner 57 dissolved or swelled by the fixing liquid 51 is pressurized by a pair of the smoothing rollers 58 and fixed on the recording medium 53 as a fixed toner 59.

The fourth embodiment of the present invention is an image forming method which forms an image of a toner containing a resin on a recording medium, in which the toner fixing method according to the second embodiment of the present invention is used.

Also, the fifth embodiment of the present invention is an image forming apparatus in which an image of a toner containing a resin is formed on a recording medium, by using the image forming method according to the fourth embodiment of the preset invention.

According to the fourth embodiment of the present invention, an image forming method can be provided which can fix a toner on a recording medium more efficiently.

Also, according to the fifth embodiment of the present invention, an image forming apparatus can be provided which can fix a toner on a recording medium more efficiently.

Figure 6A:
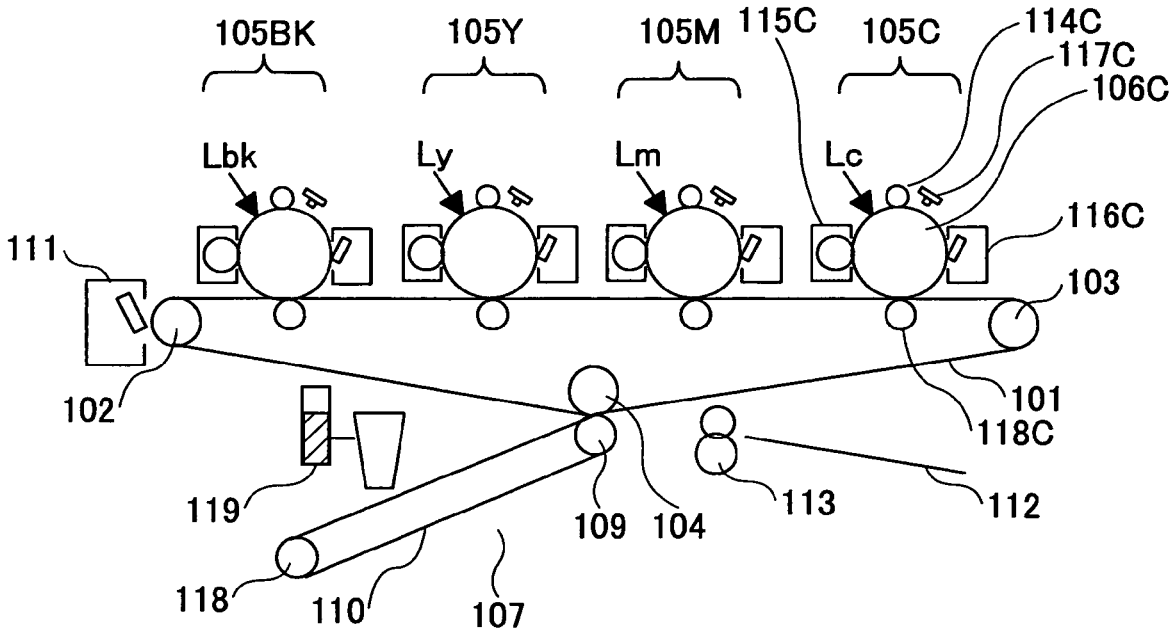
FIGS. 6A and 6B are diagrams illustrating specific examples of an image forming method and image forming apparatus according to the present invention.
Figure 6B:
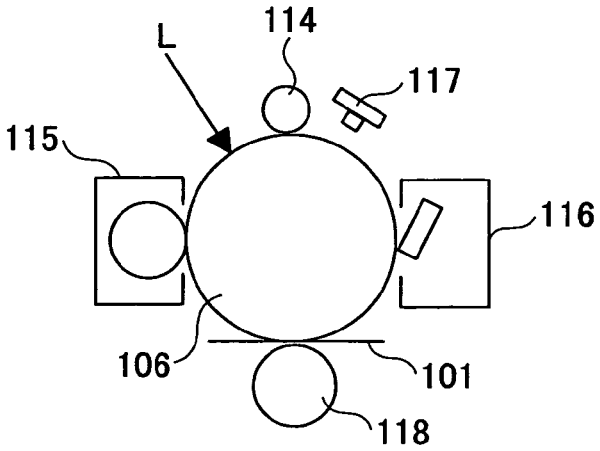

FIGS. 6A and 6B are diagrams illustrating specific examples of the image forming method and image forming apparatus according to the present invention. FIG. 6A is a diagram showing a color-electrophotographic tandem-type image forming apparatus, which may be a copying machine or a printer, and FIG. 6B shows one of image forming units of the image forming apparatus shown in FIG. 6A.

The image forming apparatus shown in FIGS. 6A and 6B has an intermediate transcription belt 101 as a toner image carrier. The intermediate transcription belt 101 is tensioned and extends on three supporting rollers 102, 103 and 104, and rotates clockwise. Image forming units 105K, 105Y, 105M and 105C for black, yellow, magenta and cyan, respectively, are arranged for the intermediate transcription belt 101. Above these image forming units, light-exposure devices which are not shown in the figures are arranged. For example, when the image forming apparatus is a copying machine, image information for an original copy is read by using a scanner and each light L is emitted from the light-exposure device in order to write an electrostatic latent image on each photoconductor drum 106 according to the image information.

A secondary transcription device 107 is provided at a location at which it opposes the supporting roller 104 for the intermediate transcription belt 101. The secondary transcription device 107 is composed of a secondary transcription belt 110 which is tensioned and extends on two supporting rollers 108 and 109. Herein, a transcription roller as well as the transcription belt may be used for the secondary transcription device 107. Also, a belt cleaning device 111 is arranged at a location at which it opposes the supporting roller 102 for the intermediate transcription belt 101. The belt cleaning device 111 is arranged to eliminate a toner remaining on the intermediate transcription belt 101.

A recording paper sheet 112 as a recording medium is guided to a secondary transcription part by a pair of paper sheet feeding rollers 113, and a toner image is transcribed by forcing the secondary transcription belt 110 on the intermediate transcription belt 101 when the toner image is transcribed on the recording paper sheet 112.

The recording paper sheet 112 on which the toner image is transcribed is conveyed by the secondary transcription belt 110 and the unfixed toner image transcribed on the recording paper sheet 112 is fixed by a toner fixing device 119 according to the third embodiment of the present invention. That is, the fixing liquid according to the first embodiment of the present invention which is supplied from the toner fixing device 119 is applied to the unfixed toner image transcribed on the recording paper sheet 112, and the unfixed toner image is fixed on the recording paper sheet 112 by means of a toner softening agent contained in the fixing liquid.

Next, the image forming unit is described. As shown in FIG. 6B, a charging device 114, a developing device 115, a cleaning device 116 and a charge eliminating device 117 are arranged around the photoconductor drum 106 for the image forming unit. Also, a primary transcription device 118 is provided at a location at which it opposes the photoconductor drum 106 via the intermediate transcription belt 101.

The charging device 114 is a charging device according to a contact charging method which uses a charging roller. The charging device 114 uniformly charges the surface of the photoconductor drum 106 by contacting the charging roller with the photoconductor drum 106 and applying a voltage to the photoconductor drum 106. For the charging device 114, a charging device according to a non-contact charging method which uses, for example, a non-contact scorotron can be also used.

The developing device 115 makes a toner in a developer adhere to an electrostatic latent image on the photoconductor drum 106 so that the electrostatic latent image is visualized. Herein, each toner corresponding to each color is composed of a resin material colored with each color and the resin material can be dissolved or swelled by the fixing liquid according to the first embodiment of the present invention. Additionally, the developing device 115 has an agitation part and a developing part which are not shown in the figure and a developer which has not been used for development returns to the agitation part and is reused. The concentration of the toner in the agitation part is detected by a toner concentration sensor, which part is controlled such that the concentration of the toner is constant.

The primary transcription device 118 transcribes the toner visualized on the photoconductor drum 106 to the intermediate transcription belt 101. Herein, for the primary transcription device 118, a transcription roller is used and the transcription roller is forced on the photoconductor drum 106 while the intermediary transcription belt 101 is intervened. For the primary transcription device 118, for example, an electrically conductive brush and a non-contact corona charger can be also used.

The cleaning device 116 eliminates an unwanted toner on the photoconductor drum 106. For the cleaning device 116, a blade with an end which is forced on the photoconductor drum 106 can be used. Herein, the toner recovered by the cleaning device 116 is recovered into and reused in the developing device 115 by a recovering screw and a toner recycle device which are not shown in the figure.

The charge eliminating device 117 is composed of a lamp and initializes the surface electric potential of the photoconductor drum 106 by means of light irradiation.

Next, the embodiments of the present invention are described using practical examples. Herein, a toner softening liquid in the following practical examples and comparative examples means a liquid for dissolving or swelling at least a portion of a resin contained in a toner (a liquid of toner softening agent).

PRACTICAL EXAMPLE 1

After 2% by weight of diisobutyl adipate (surface tension=36 mN/m, $LD_{50}$=12.8 g/kg) as a softening agent of liquid for softening a toner, 97% by weight of propylene glycol (viscosity: 48 mPa·sec, surface tension=70 mN/m, $LD_{50}$=15 g/kg) as an aqueous dispersive medium, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a clear (slightly pale-blue) fixing liquid of micro-emulsion in which diisobutyl adipate was dispersed in propylene glycol. The surface tension of the overall fixing liquid was 35 mN/m.

In regard to the prepared fixing liquid, the particle size distribution of the fixing liquid at 25° C. was measured by using a particle size measurement apparatus (a particle size analyzer available from Honeywell International Inc.: Microtrac UPA) which used a Doppler light scattering method. The number average particle diameter of fine particles dispersed in the fixing liquid was approximately 20 nm.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, at the 1 second after, no toner adhered to the waste and the toner had adhered to the PPC paper sheet. Also, the odor intensity index of diisobutyl adipate was 1, the odor intensity index of propylene glycol was 0, and the odor intensity index of the fixing liquid was 0. Additionally, at the time of fixation of the toner image, no unpleasant odor was generated in the laboratory. Further, as the fixed toner image was observed by using an optical microscope, no disturbance of a fixed toner layer and a good fixed toner layer were observed on the PPC paper sheet. Also, after the fixing liquid was applied, propylene glycol as a dispersive medium vaporized and a fixed image which was excellent in hand feeling was obtained.

Comparative Example 1

After 2% by weight of diethoxyethyl succinate (surface tension=35 mN/m, $LD_{50}$=5 g/kg) as a softening agent of liquid for softening a toner, 97% by weight of propylene glycol (viscosity: 48 mPa·sec, surface tension=70 mN/m, $LD_{50}$=15 g/kg) as an aqueous dispersive medium, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a fixing liquid of clear solution in which diethoxyethyl succinate was dissolved in propylene glycol. The surface tension of the overall fixing liquid was 35 mN/m.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, no disturbance of the toner image was observed but, even at the 20 seconds after, when the surface of the image was rubbed with a waste, the toner adhered to the waste and no toner was fixed to the PPC paper sheet. After 1 hour had passed subsequently, the toner image was rubbed with a waste again and the toner was separated from the paper sheet and was not fixed.

PRACTICAL EXAMPLE 2

After 3% by weight of dibutyl sebacate (surface tension=35 mN/m, $LD_{50}$=12.8 g/kg) as a softening agent of liquid for softening a toner, 96% by weight of ethanol (viscosity: 1 mPa·sec, surface tension=22 mN/m, $LD_{50}$=15 g/kg) as an aqueous dispersive medium, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a clear (slightly pale-blue) fixing liquid of micro-emulsion in which dibutyl sebacate was dispersed in ethanol. The surface tension of the overall fixing liquid was 24 mN/m.

In regard to the prepared fixing liquid, the particle size distribution of the fixing liquid at 25° C. was measured by using a particle size measurement apparatus (a particle size analyzer available from Honeywell International Inc.: Microtrac UPA) which used a Doppler light scattering method. The number average particle diameter of fine particles dispersed in the fixing liquid was approximately 5 nm.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, at the 1 second after, no toner adhered to the waste and the toner had adhered to the PPC paper sheet. Also, the odor intensity index of dibutyl sebacate was 0 and the odor intensity index of the toner after fixation was 0. Additionally, at the time of fixation of the toner image, no unpleasant odor was generated in the laboratory. Further, as the fixed toner image was observed by using an optical microscope, no disturbance of a fixed toner layer and a good fixed toner layer were observed on the PPC paper sheet. Also, after the fixing liquid was applied, ethanol as a dispersive medium vaporized and a fixed image which was excellent in hand feeling was obtained.

Comparative Example 2

After 2% by weight of diethoxyethyl succinate (surface tension=35 mN/m, $LD_{50}$=5 g/kg) as a softening agent of liquid for softening a toner, 96% by weight of ethanol (viscosity: 1 mPa·sec, surface tension=22 mN/m, $LD_{50}$=15 g/kg) as an aqueous dispersive medium, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a fixing liquid of clear solution in which diethoxyethyl succinate was dissolved in ethanol. The surface tension of the overall fixing liquid was 24 mN/m.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, no disturbance of the toner image was observed but, even at the 20 seconds after, when the surface of the image was rubbed with a waste, the toner adhered to the waste and no toner was fixed to the PPC paper sheet. After 1 hour had passed subsequently, the toner image was rubbed with a waste again and the toner was separated from the paper sheet and was not fixed.

PRACTICAL EXAMPLE 3

After 3% by weight of ethyl laurate (surface tension=28 mN/m, $LD_{50}$=3 g/kg) as a softening agent of liquid for softening a toner, 96% by weight of propylene glycol (viscosity: 48 mPa·sec, surface tension=70 mN/m, $LD_{50}$=15 g/kg) as an aqueous dispersive medium, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a clear (slightly pale-blue) fixing liquid of micro-emulsion in which ethyl laurate was dispersed in propylene glycol. The surface tension of the overall fixing liquid was 32 mN/m.

In regard to the prepared fixing liquid, the particle size distribution of the fixing liquid at 25° C. was measured by using a particle size measurement apparatus (a particle size analyzer available from Honeywell International Inc.: Microtrac UPA) which used a Doppler light scattering method. The number average particle diameter of fine particles dispersed in the fixing liquid was approximately 70 nm.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, at the 1 second after, no toner adhered to the waste and the toner had adhered to the PPC paper sheet. Also, the odor intensity index of ethyl laurate was 1, the odor intensity index of propylene glycol was 0, and the odor intensity index of the fixing liquid was 0. Additionally, at the time of fixation of the toner image, no unpleasant odor was generated in the laboratory. Further, as the fixed toner image was observed by using an optical microscope, no disturbance of a fixed toner layer and a good fixed toner layer were observed on the PPC paper sheet. Also, after the fixing liquid was applied, propylene glycol as a dispersive medium vaporized and a fixed image which was excellent in hand feeling was obtained.

Comparative Example 3

After 3% by weight of ethyl laurate (surface tension=28 mN/m, $LD_{50}$=5 g/kg) as a softening agent of liquid for softening a toner and 97% by weight of dimethylsilicone (viscosity: 50 mPa·sec, surface tension=20 mN/m, $LD_{50}$=15 g/kg) as an aqueous dispersive medium were mixed, the mixture was stirred by a stirrer so as to prepare a fixing liquid of clear solution in which ethyl laurate was dissolved in dimethylsilicone. The surface tension of the overall fixing liquid was 21 mN/m.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, no disturbance of the toner image was observed but, even at the 20 seconds after, when the surface of the image was rubbed with a waste, the toner adhered to the waste and no toner was fixed to the PPC paper sheet. After 1 hour had passed subsequently, the toner image was rubbed with a waste again and the toner was separated from the paper sheet and was not fixed.

PRACTICAL EXAMPLE 4

After 2% by weight of diisobutyl adipate (surface tension=36 mN/m, $LD_{50}$=12.8 g/kg) as a softening agent of liquid for softening a toner, 70% by weight of propylene glycol (viscosity: 48 mPa·sec, surface tension=70 mN/m, $LD_{50}$=15 g/kg) and 27% by weight of 1,3-butanediol (viscosity: 98 mPa·sec, surface tension=38 mN/m, $LD_{50}$=10 g/kg) as aqueous dispersive media, and 1% by weight of polyoxyalkyl-modified silicone-type surfactant (HLB value=13) (available from Dow Corning Toray Co., Ltd.: SH3746) were mixed, the mixture was stirred by a stirrer so as to prepare a clear (slightly pale-blue) fixing liquid of micro-emulsion in which diisobutyl adipate was dispersed in propylene glycol. The surface tension of the overall fixing liquid was 35 mN/m.

In regard to the prepared fixing liquid, the particle size distribution of the fixing liquid at 25° C. was measured by using a particle size measurement apparatus (a particle size analyzer available from Honeywell International Inc.: Microtrac UPA) which used a Doppler light scattering method. The number average particle diameter of fine particles dispersed in the fixing liquid was approximately 20 nm.

An unfixed toner image was formed on a PPC paper sheet in a color MFP machine (Ipsio Neo C455 (available from Ricoh Company, Ltd.)) on the condition of removing a fixation unit thereof. The fixing liquid was spray-applied on the obtained unfixed toner image and the surface of the image was rubbed with a waste after 1 second, 10 seconds, and 20 seconds. Then, the degree of fixation of the toner to the PPC paper sheet was evaluated based on the presence or absence of adhesion of the toner to the waste.

As a result, at the 1 second after, no toner adhered to the waste and the toner had adhered to the PPC paper sheet. Also, the odor intensity index of diisobutyl adipate was 1, the odor intensity indices of propylene glycol and 1,3-butanediol were 0, and the odor intensity index of the fixing liquid was 0. Additionally, at the time of fixation of the toner image, no unpleasant odor was generated in the laboratory. Further, as the fixed toner image was observed by using an optical microscope, no disturbance of a fixed toner layer and a good fixed toner layer were observed on the PPC paper sheet. Also, after the fixing liquid was applied, propylene glycol and 1,3-butanediol as dispersive media vaporized and a fixed image which was excellent in hand feeling was obtained.

From the results described above, it was confirmed that any of the fixing liquids of micro-emulsion shown in practical examples 1, 2, 3 and 4 could fix a toner on a recording medium more efficiently (for a shorter time period) than the fixing liquids of solution shown in comparative examples 1, 2, and 3.

APPENDIX

Typical embodiments (1) to (22) of the present invention are described below.

Embodiment (1)

A fixing liquid which fixes a toner comprising a resin on a recording medium, characterized in that a fluid particle comprising a component which dissolves or swells at least a portion of the resin comprised in the toner is dispersed in a dispersive medium, as a micro-emulsion.

Embodiment (2)

The fixing liquid as described in embodiment (1) above, characterized in that a number average particle diameter of the fluid particle is equal to or greater than 1 nm and equal to or less than 100 nm.

Embodiment (3)

The fixing liquid as described in embodiment (1) or (2) above, characterized in that the dispersive medium comprises an alcohol.

Embodiment (4)

The fixing liquid as described in embodiment (3) above, characterized in that the alcohol comprises propylene glycol or 1,3-butanediol.

Embodiment (5)

The fixing liquid as described in embodiment (3) above, characterized in that the alcohol comprises ethanol.

Embodiment (6)

The fixing liquid as described in any of embodiments (1) to (5) above, characterized in that the dispersive medium comprises no water.

Embodiment (7)

The fixing liquid as described in any of embodiments (1) to (6) above, characterized in that a surface tension of the dispersive medium is equal to or greater than 20 mN/m and equal to or less than 40 mN/m.

Embodiment (8)

The fixing liquid as described in any of embodiments (1) to (7) above, characterized in that a surface tension of the fluid particle is equal to or greater than 20 mN/m and equal to or less than 40 mN/m.

Embodiment (9)

The fixing liquid as described in any of embodiments (1) to (8) above, characterized in that a content of the fluid particles in the dispersive medium is equal to or greater than 0.5% by weight and equal to or less than 50% by weight.

Embodiment (10)

The fixing liquid as described in any of embodiments (1) to (9) above, characterized by further comprising a surfactant.

Embodiment (11)

The fixing liquid as described in embodiment (10) above, characterized in that an HLB value of the surfactant is equal to or greater than 10.

Embodiment (12)

The fixing liquid as described in any of embodiments (1) to (11) above, characterized in that the component which dissolves or swells at least a portion of the resin comprised in the toner comprises an aliphatic ester.

Embodiment (13)

The fixing liquid as described in embodiment (12) above, characterized in that the aliphatic ester comprises a saturated aliphatic ester.

Embodiment (14)

The fixing liquid as described in embodiment (13) above, characterized in that the saturated aliphatic ester comprises a compound represented by a general formula of $R_1COOR_2$, wherein $R_1$ is an alkyl group whose carbon number is equal to or geater than 11 and equal to or less than 14 and $R_2$ is an alkyl group whose carbon number is equal to or geater than 1 and equal to or less than 3.

Embodiment (15)

The fixing liquid as described in any of embodiments (12) to (14) above, characterized in that the aliphatic ester comprises an aliphatic dicarboxylic acid ester.

Embodiment (16)

The fixing liquid as described in embodiment (15) above, characterized in that the aliphatic dicarboxylic acid ester comprises a compound represented by a general formula of $R_3(COOR_4)_2$, wherein $R_3$ is an alkylene group whose carbon number is equal to or geater than 3 and equal to or less than 8 and $R_4$ is an alkyl group whose carbon number is equal to or greater than 2 and equal to or less than 5.

Embodiment (17)

The fixing liquid as described in any of embodiments (12) to (16) above, characterized in that the aliphatic ester comprises a dialkoxyalkyl aliphatic dicarboxylate.

Embodiment (18)

The fixing liquid as described in embodiment (17) above, characterized in that the dialkoxyalkyl aliphatic dicarboxylate comprises a compound represented by a general formula of $R_5(COOR_6—O—R_7)_2$, wherein $R_5$ is an alkylene group whose carbon number is equal to or geater than 2 and equal to or less than 8, $R_6$ is an alkylene group whose carbon number is equal to or geater than 2 and equal to or less than 4, and $R_7$ is an alkyl group whose carbon number is equal to or geater than 1 and equal to or less than 4.

Embodiment (19)

A toner fixing method which fixes a toner comprising a resin on a recording medium, characterized in that the fixing liquid as described in any of embodiments (1) to (18) above is used.

Embodiment (20)

A toner fixing device characterized in that a toner comprising a resin is fixed on a recording medium by using the toner fixing method as described in embodiment (19) above.

Embodiment (21)

An image forming method which forms an image of a toner comprising a resin on a recording medium, characterized in that the toner fixing method as described in embodiment (19) above is used.

Embodiment (22)

An image forming apparatus characterized in that an image of a toner comprising a resin is formed on a recording medium by using the image forming method as described in embodiment (21) above.

According to typical embodiments (1) to (22) of the present invention, a fixing liquid, a toner fixing method, a toner fixing device, an image forming method, and an image forming apparatus can be provided which are capable of fixing a toner on a recording medium more efficiently.

Although the embodiment(s) and example(s) of the present invention have been specifically described hereinbefore, the present invention is not limited to the specifically disclosed embodiment(s) or example(s), and the embodiment(s) and example(s) of the present invention can be varied or modified without departing from the spirit and scope of the present invention.

The present application claims the priority based on Japanese Patent Application No. 2005-380472 filed on Dec. 28, 2005, the entire contents of which are hereby incorporated by reference.

What is claimed is:

1. A fixing liquid which fixes a toner comprising a resin on a recording medium, in which a fluid particle comprising a component which dissolves or swells at least a portion of the resin comprised in the toner is dispersed in a dispersive medium, as a micro-emulsion in which a number average particle diameter of the fluid particle is equal to or greater than 1 nm and equal to or less than 100 nm.

2. The fixing liquid as claimed in claim 1, in which the dispersive medium comprises an alcohol.

3. The fixing liquid as claimed in claim 2, in which the alcohol comprises propylene glycol or 1,3-butanediol.

4. The fixing liquid as claimed in claim 2, in which the alcohol comprises ethanol.

5. The fixing liquid as claimed in claim 1, in which the dispersive medium comprises no water.

6. The fixing liquid as claimed in claim 1, in which a surface tension of the dispersive medium is equal to or greater than 20 mN/m and equal to or less than 40 mN/m.

7. The fixing liquid as claimed in claim 1, in which a surface tension of the fluid particle is equal to or greater than 20 mN/m and equal to or less than 40 mN/m.

8. The fixing liquid as claimed in claim 1, in which a content of the fluid particles in the dispersive medium is equal to or greater than 0.5% by weight and equal to or less than 50% by weight.

9. The fixing liquid as claimed in claim 1, which further comprises a surfactant.

10. The fixing liquid as claimed in claim 9, in which an HLB value of the surfactant is equal to or greater than 10.

11. The fixing liquid as claimed in claim 1, in which the component which dissolves or swells at least a portion of the resin comprised in the toner comprises an aliphatic ester.

12. The fixing liquid as claimed in claim 11, in which the aliphatic ester comprises a saturated aliphatic ester.

13. The fixing liquid as claimed in claim 12, in which the saturated aliphatic ester comprises a compound represented by a general formula of $R_1COOR_2$, wherein $R_1$ is an alkyl group whose carbon number is equal to or greater than 11 and equal to or less than 14 and $R_2$ is an alkyl group whose carbon number is equal to or greater than 1 and equal to or less than 3.

14. The fixing liquid as claimed in claim 11, in which the aliphatic ester comprises an aliphatic dicarboxylic acid ester.

15. The fixing liquid as claimed in claim 14, in which the aliphatic dicarboxylic acid ester comprises a compound represented by a general formula of $R_3(COOR_4)_2$, wherein $R_3$ is an alkylene group whose carbon number is equal to or greater than 3 and equal to or less than 8 and $R_4$ is an alkyl group whose carbon number is equal to or greater than 2 and equal to or less than 5.

16. The fixing liquid as claimed in claim 11, in which the aliphatic ester comprises a dialkoxyalkyl aliphatic dicarboxylate.

17. The fixing liquid as claimed in claim 16, in which the dialkoxyalkyl aliphatic dicarboxylate comprises a compound represented by a general formula of $R_5(COOR_6—O—R_7)_2$, wherein $R_5$ is an alkylene group whose carbon number is equal to or greater than 2 and equal to or less than 8, $R_6$ is an alkylene group whose carbon number is equal to or greater than 2 and equal to or less than 4, and $R_7$ is an alkyl group whose carbon number is equal to or greater than 1 and equal to or less than 4.

18. A toner fixing device in which a toner comprising a resin is fixed on a recording medium by using the fixing liquid as claimed in claim 1.

19. An image forming apparatus in which an image of a toner comprising a resin is formed on a recording medium by using the fixing liquid as claimed in claim 1.

* * * * *